US005724670A

United States Patent [19]

Price

[11] Patent Number: 5,724,670

[45] Date of Patent: Mar. 10, 1998

[54] MULTI-COMPONENT BALLISTIC VEST

[75] Inventor: Allen L. Price, Rising Sun, Md.

[73] Assignee: Safariland Ltd., Inc., Ontario, Calif.

[21] Appl. No.: 725,535

[22] Filed: Oct. 3, 1996

[51] Int. Cl.[6] ..... F41H 1/02

[52] U.S. Cl. ..... 2/2.5

[58] Field of Search ..... 2/2.5, 455, 456, 2/463, 467; 428/911, 340; 442/246, 286, 390, 297, 298, 255, 269, 301, 333, 366; 89/36.01, 36.05, 36.02

[56] References Cited

U.S. PATENT DOCUMENTS

| | | | |
|---|---|---|---|
| 3,582,988 | 6/1971 | Armellino | 2/2.5 |
| 3,924,038 | 12/1975 | McArdle et al. | 428/49 |
| 4,403,012 | 9/1983 | Harpell et al. | 428/290 |
| 4,457,985 | 7/1984 | Harpell et al. | 428/224 |
| 4,501,856 | 2/1985 | Harpell et al. | 525/240 |
| 4,623,574 | 11/1986 | Harpell et al. | 428/113 |
| 4,650,710 | 3/1987 | Harpell et al. | 428/263 |
| 4,681,792 | 7/1987 | Harpell et al. | 428/102 |
| 4,879,165 | 11/1989 | Smith | 428/212 |
| 4,989,266 | 2/1991 | Borgese et al. | 2/2.5 |
| 5,008,959 | 4/1991 | Coppage, Jr. et al. | 2/2.5 |
| 5,112,667 | 5/1992 | Li et al. | 428/113 |
| 5,185,195 | 2/1993 | Harpell et al. | 428/102 |
| 5,327,811 | 7/1994 | Price et al. | 89/36.05 |
| 5,395,671 | 3/1995 | Coppage, Jr. et al. | 428/102 |

FOREIGN PATENT DOCUMENTS

| | | |
|---|---|---|
| 2198628 | 6/1988 | United Kingdom . |
| 87/03674 | 6/1987 | WIPO . |

*Primary Examiner*—C. D. Crowder
*Assistant Examiner*—Larry D. Worrell, Jr.
*Attorney, Agent, or Firm*—Christie, Parker & Hale, LLP

[57] ABSTRACT

A multi-component ballistic package for a ballistic vest comprises a first sub-panel on the strike side of the vest having overlying plies of woven ballistic fabric, a second sub-panel behind the first sub-panel comprising overlying plies of woven ballistic fabric, a third sub-panel behind the second sub-panel comprising overlying layers of ballistic fiber-reinforced thermoplastic sheets, and the fourth sub-panel behind the third sub-panel on the body side of the vest comprising overlying layers of ballistic fiber-reinforced plastic sheets. The individual plies and layers of each of the sub-panels are secured together as separate units to form, in one embodiment of the invention, a four-component structure. The preferred woven fibers are 180 denier high molecular weight extended chain polyethylene fibers. The preferred fiber reinforced sheet material comprises unidirectional extended chain polyethylene fibers. In one embodiment Threat Level III-A NIJ certification standards are achieved with a ballistic package having an areal weight less than one pound per square foot.

15 Claims, 2 Drawing Sheets

MULTI-COMPONENT BALLISTIC VEST

FIELD OF THE INVENTION

This invention relates to protective vests, and more particularly, to body armor commonly known as a ballistic vest.

BACKGROUND OF THE INVENTION

Ballistic vests have saved the lives of many law enforcement officers in recent years. As a result, law enforcement agencies have made it mandatory for their officers to wear ballistic vests while on duty.

Ballistic vests have been available in recent years as a protective panel with overlying layers of a fabric made from woven high tensile strength ballistic-resistant polymeric fibers. Woven fabrics made from an aramid fiber known as KEVLAR, for example, have been used successfully in ballistic vests because of the high energy absorption properties of the fabric material. The material is also reasonably light in weight and flexible, which provides improved comfort when compared with previous vests made of nylon or metal which were heavier and more rigid.

The comfort of a ballistic vest is extremely important, especially to law enforcement officers, because of the heat build-up that occurs from wearing a heavy and inflexible vest for the long hours an officer is on duty. Resistance to projectile penetration is a principal factor in designing a ballistic vest; and added protective layers can offer great protection against projectiles having higher threat levels, but added protective layers also add undesired weight and inflexibility of the vest.

In addition to woven KEVLAR fabric layers, ballistic vests have been made from other high performance synthetic fibers and composites to reduce weight and improve flexibility. However, ballistic vests using the lighter, more flexible ballistic materials also must offer the required minimal levels of protection against penetration by different types of projectiles.

Ballistic vests are regularly certified by ballistics testing to measure their ability to protect against different projectiles fired from different types of weapons at various angles. One ballistic test commonly used in the industry is the National Institute of Justice (NIJ) Standard 0101.03 which, in general terms, is a high performance standard requiring the ballistic vest to prevent penetration of specified rounds fired at velocities up to 1450 ft/sec. In addition to preventing such projectile penetration, "backface deformation" also is a required test factor in the NIJ Standard 0101.03 certification test. Backface deformation indirectly measures the trauma level experienced by a user from a projectile that does not penetrate the test panel. According to this test, the maximum allowable backface signature (bfs) containment for soft body armor requires a maximum allowable bfs of 44 mm for all rounds.

There is a need to provide a ballistic vest that is reasonably light in weight, flexible and comfortable, and is also capable of meeting the NIJ high performance projectile test specifications. Providing such a vest at a reasonably low cost for the comparable high performance level is also a desired objective.

SUMMARY OF THE INVENTION

Briefly, one embodiment of the invention comprises a multi-component ballistic vest of the soft body armor type which includes a composite ballistic package comprising a first flexible sub-panel on a strike side of the vest, a second flexible sub-panel positioned adjacent the first sub-panel, a third flexible sub-panel positioned adjacent to the second sub-panel, and a fourth flexible sub-panel on a body side of the vest. The first flexible sub-panel comprises a first group of flexible woven fabric layers arranged in a stack in face-to-face surface contact. Each first woven fabric layer comprises an array of woven high molecular weight high tensile strength ballistic- resistant polymeric fibers, the individual first woven fabric layers being secured to each other to form a flexible unitary first sub-panel. The second flexible sub-panel comprises a second group of flexible woven fabric layers arranged in a stack in face-to-face surface contact. Each second woven fabric layer comprises an array of woven ultra high molecular weight high tensile strength ballistic-resistant polymeric fibers, the individual second woven fabric layers being secured to each other to form a flexible unitary second sub-panel. The third flexible sub-panel comprises a group of flexible imperforate ballistic fiber-reenforced plastic sheets arranged in a stack in face-to-face surface contact. Each fiber-reinforced sheet of the third sub-panel comprises an array of non-woven ballistic-resistant plastic fibers embedded in a resinous matrix type film, the individual ballistic fiber-reinforced plastic sheets of the third sub-panel being secured to each other to form a flexible unitary third sub-panel. The fourth flexible sub-panel comprises a group of flexible imperforate ballistic fiber-reinforced plastic sheets arranged in a stack in face-to-face surface contact. Each imperforate plastic sheet of the fourth sub-panel comprises an array of non-woven plastic fibers embedded in a resinous matrix type film, the individual fiber-reinforced sheets of the fourth sub-panel being secured to each other to form a flexible unitary fourth sub-panel. The ballistic resistance of the composite ballistic package is provided essentially in its entirety from the strike side of the composite panel through the first, second, third and fourth sub-panels to the body side of the ballistic package. The first, second, third and fourth flexible sub-panels have a combined areal weight not greater than about one pound per square foot and have an NIJ standard maximum backface of about 44 mm with a ballistic resistance that prevents projectile penetration of the combined first, second, third and fourth flexible sub-panels according to NIJ Standard 0101.03 for Threat Level III-A.

In a preferred form of the invention, the fibers contained in the first and second sub-panels comprise extended chain polyethylene fibers, preferably 180 denier fibers. The unidirectional fiber-reinforced layers of the third and fourth sub-panels preferably also comprise extended chain polyethylene fibers. In this embodiment the high performance is achieved with the combined areal weight not greater than about one pound per square foot.

In another form of the invention, woven ballistic fabric layers on the strike side of the ballistic package are separated into the two sub-panels. The woven fabric layers in the first or front sub-panel are substantially greater in number than the number of woven fabric layers in the second sub-panel. The ballistic package also includes at least one additional third sub-panel on the body side of the vest comprised of unidirectional ballistic fiber-reinforced plastic sheets. It has been discovered that by dividing the woven fabric sheets on the strike side into the two sub-panels and providing at least one and preferably two sub-panels of unidirectional fiber-reinforced plastic sheets on the body side, energy absorption and deflection are greatly improved. In one embodiment the unidirectional fiber-reinforced plastic layers are divided into two sub-panels for providing a good combination of deflection and energy absorption.

The result of the invention is a ballistic vest that is reasonably light in weight, highly flexible and comfortable, while providing high performance Threat Level III-A resistance to ballistic penetration and backface deformation. This combination of properties is in addition to a reasonably low cost of the vest for the high performance level achieved.

These and other aspects of the invention will be more fully understood by referring to the following detailed description and the accompanying drawings.

DETAILED DESCRIPTION

Figure 1:
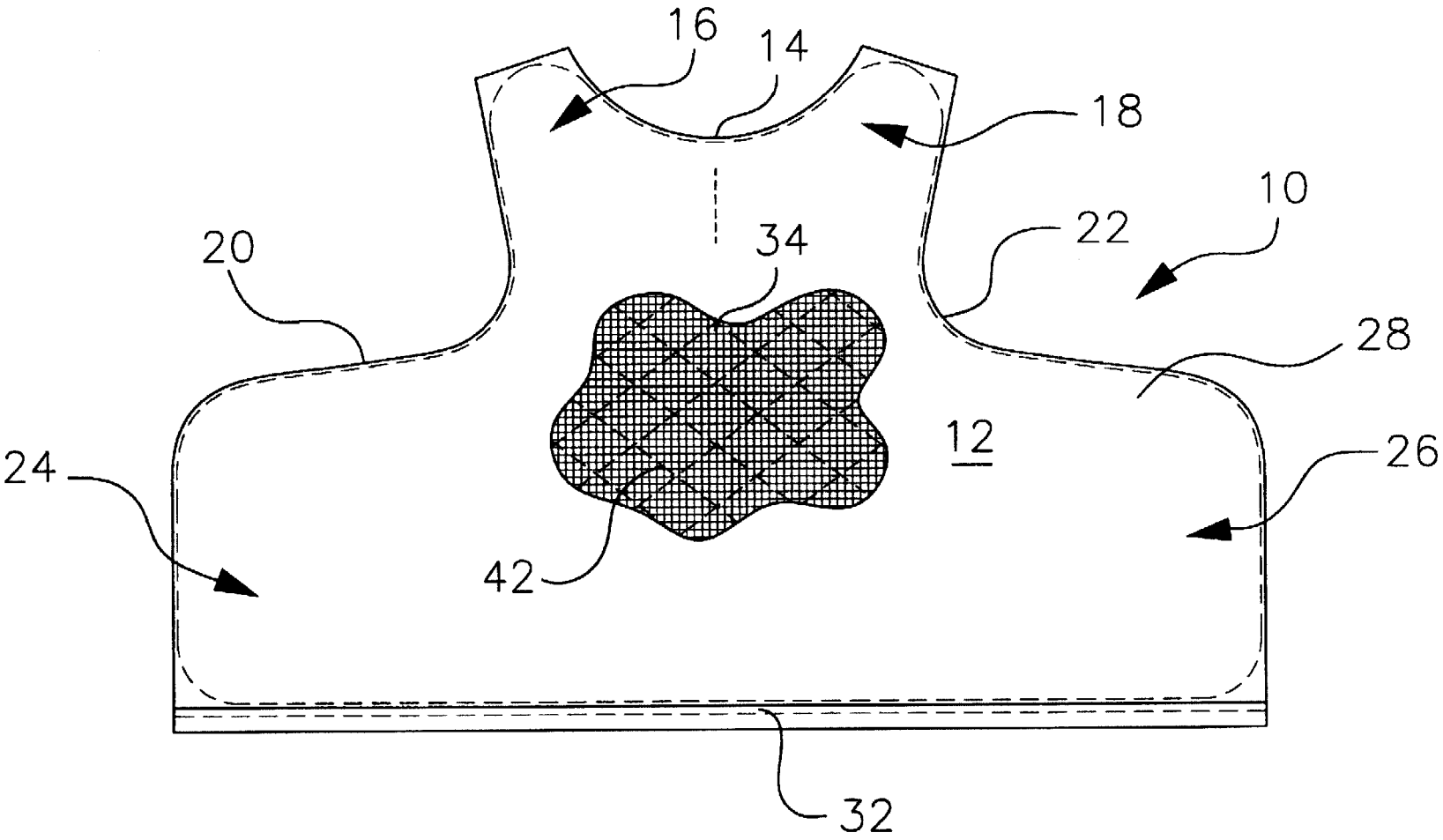
FIG. 1 is a front elevational view, partly broken away, showing a ballistic-resistant composite panel used in a ballistic vest according to the principles of this invention.

FIG. 1 illustrates a composite front ballistic panel 10 for a ballistic vest of the soft body armor type commonly worn by law enforcement officers. The composite front ballistic panel 10 provides a protective front section of the vest that overlies the chest region of the user. A separate rear protective region of the vest (not shown) overlies the back of the user. The composite front panel only is depicted in the drawings since the protective back section of the vest has a composite construction substantially identical to the front section. Therefore, the description of the composite front panel to follow will suffice for the rear panel used in the ballistic vest.

The front and rear composite protective panels are preferably carried in a vest structure which is well known in the art. The vest includes front and rear carriers for the front and rear ballistic panels, with shoulder straps and waist straps for securing the vest to the upper torso of the user. A ballistic vest with front and rear carriers that can be used for carrying the front and rear ballistic panels of this invention is described in U.S. Pat. No. 4,697,285, which is assigned to the assignee of this application and is incorporated herein by this reference.

Referring again to FIG. 1, the composite front ballistic panel 10 is generally configured to include a main body portion 12 that covers the chest region of the user, a recessed upper scoop neck region 14 for fitting under the neck, right and left upwardly projecting shoulder regions 16 and 18 for covering the right and left shoulders, recessed right and left arm regions 20 and 22 for fitting under the right and left arms of the user, and right and left side regions 24 and 26 for extending along the sides of the user when the panel is placed in a front carrier of the vest and worn over the chest.

Figure 2:
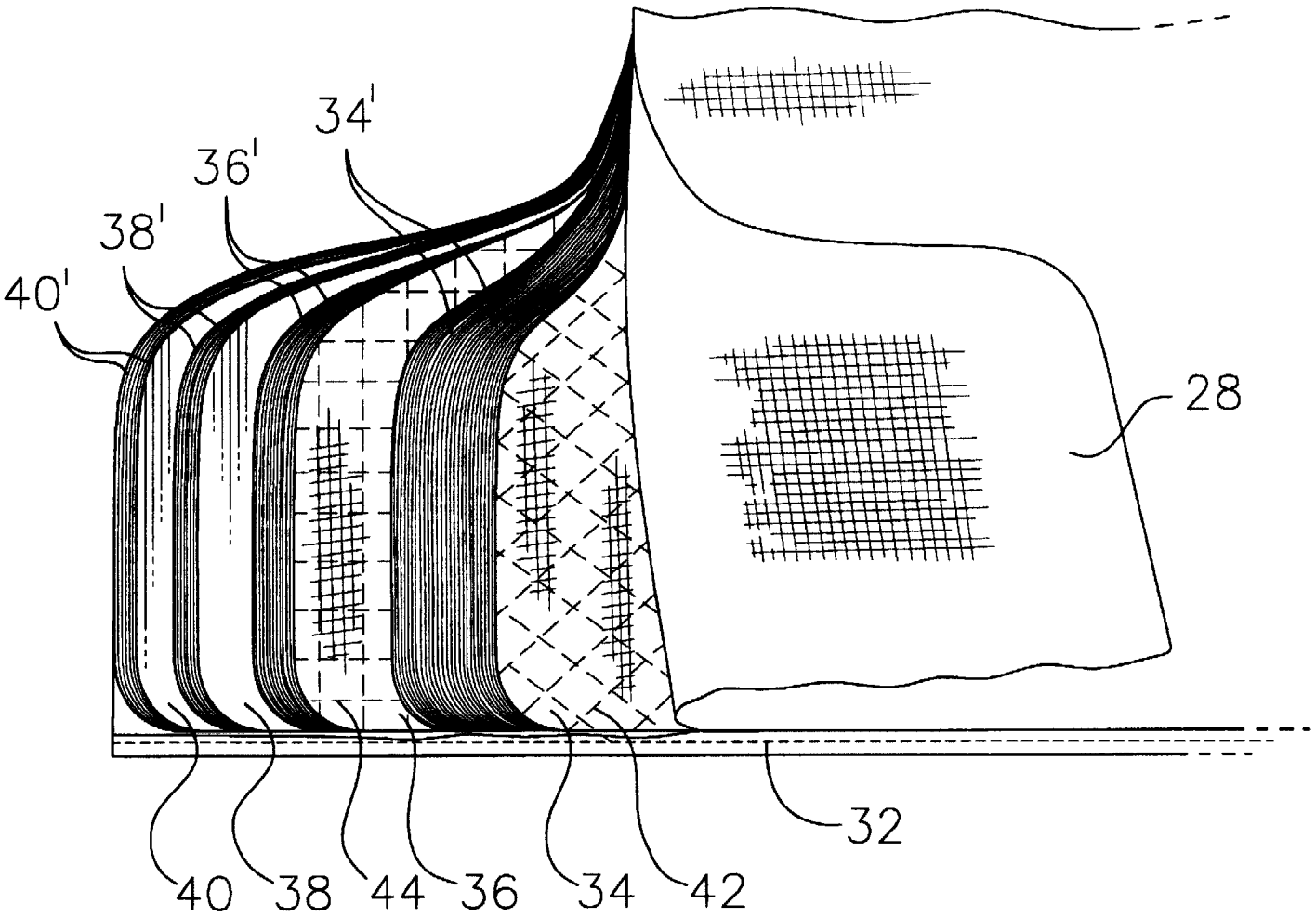
FIG. 2 is a schematic cross-sectional view showing individual layers of a multi-component ballistic vest according to principles of this invention.

Referring to FIGS. 1 and 2, the composite front ballistic panel 10 includes an outer casing 28 made of front and rear sheets of an imperforate flexible waterproof fabric, such as ripstop nylon. The front sheet of the casing is shown at 28 in FIG. 1 and the rear sheet is shown at 30 in FIG. 2. The flexible front and rear sheets of the casing are secured together around the perimeter of the front panel 10 by stitching, such as the stitching shown at 32 in FIG. 1, which forms a bottom hem for the casing.

In one embodiment of the invention, the front ballistic panel 10 comprises a four-component ballistic package consisting of first, second, third and fourth flexible ballistic panels 34, 36, 38 and 40 arranged as a group of separate panels in a stack progressing from the front or strike side of the vest to a rear or body side of the vest. (The first, second, third and fourth ballistic panels are also referred to herein as sub-panels.) The first flexible ballistic panel 34 comprises a plurality of first flexible ballistic-resistant plies 34' on the strike side of the vest. Each first ply comprises a thin, flexible ballistic fabric made of high performance ballistic-resistant polymeric fibers woven together to form a woven ballistic fabric. The individual ballistic-resistant woven fabric plies are secured to each other by quilt stitching 42 to form a soft, flexible ballistic-resistant first panel of the ballistic package.

The composite ballistic package also includes as its second panel 36 a plurality of second flexible ballistic-resistant plies 36' comprising thin, flexible ballistic fabric layers of woven high performance ballistic-resistant polymeric fibers. The individual woven ballistic fabric layers are secured together by quilt stitching 44 to form a soft, flexible woven fabric ballistic-resistant second panel separate from the first panel positioned adjacent to and behind the first panel in the ballistic package.

The composite ballistic package includes as its third panel 38 a plurality of overlying flexible unidirectional ballistic fiber-reinforced plastic sheets 38'. The individual unidirectional ballistic fiber-reinforced sheets comprise flexible high performance ballistic-resistant polymeric fibers coated with resin and cross- plied at 90° to form a unidirectional ballistic fiber-reinforced thermoplastic film sheet. The individual fiber-reinforced ballistic-resistant sheets of the third panel are secured together as a unit preferably by bar stitching. The third panel is positioned adjacent to and behind the second panel in the ballistic package.

The composite ballistic package includes as the fourth panel 40 a plurality of overlying flexible unidirectional ballistic fiber-reinforced sheets 40'. The individual unidirectional ballistic fiber-reinforced sheets comprise flexible high performance ballistic- resistant polymeric fibers coated with resin and cross-plied at 90° to form a unidirectional ballistic fiber reinforced thermoplastic film sheet. The individual fiber-reinforced ballistic-resistant sheets of the fourth panel are secured together as a unit preferably by bar stitching. The fourth panel is positioned adjacent to and behind the third panel and forms the panel adjacent the rear or body side of the ballistic vest package.

The four individual panels of the composite ballistic package are freely movable relative to one another within the casing of the ballistic vest without being laminated to each other or otherwise bonded to each other in a face to face relation. In addition, the individual plies of ballistic fabric or sheets within each individual panel also lie face to face with one another without being bonded to each other than by the quilt stitching or bar tack arrangement. The individual plies of the first, second, third and fourth panels are all cut to the same size and shape and overlie one another in layers parallel to one another. FIG. 2 shows a cut-away view of the front face of the outer casing to reveal the stacks of first, second, third and fourth panels of the composite front ballistic panel 10.

The first flexible ballistic-resistant plies 34' of the first ballistic panel 34 will now be described. Each first ply 34' preferably comprises a flexible fabric made of woven high strength polymeric fibers which exhibit useful ballistic resistance in the woven form of the fabric. The preferred fabric is a plain woven fabric made of uncoated extended chain polyethylene fibers. In one embodiment of the invention, the extended chain polyethylene fibers are the high strength ballistic-resistant fibers made of ultra high molecular weight highly oriented polyethylene fibers as described in U.S. Pat. No. 4,681,792 assigned to Allied Signal and incorporated herein by this reference. The individual extended chain polyethylene fibers are preferably 180 denier fibers. The fibers contained in the fabric have a fiber tenacity of at least about 30 grams/denier and more preferably above 35 grams/denier nominal. In a preferred form of the invention the 180 denier fibers have a fiber tenacity of about 38–39 grams/denier. The tensile modulus of the fibers as measured on an Instron tensile machine is above 2,000 grams/denier and more preferably about 2,500 grams/denier. The fibers have a maximum elongation of about 3.1%. The total fiber areal density of the woven fabric is about 2.3 oz/yd$^2$. The fabric is constructed in a plain weave with 47 ends per inch in the warp direction and 47 ends per inch in the fill direction. The preferred woven fabric is available under the designation SPECTRA 2000, 180 denier from Allied Signal. The woven fabric plies 34' are quilt stitched preferably on approximately one inch centers to form the unitary flexible front panel section 34.

The ballistic-resistant plies 36' of the second panel 36 also preferably comprise a flexible fabric made of woven extended chain polyethylene fibers such as the high strength ballistic-resistant fibers made of ultra high molecular weight highly oriented polyethylene fibers available under the designation SPECTRA 2000, 180 denier from Allied Signal.

Although the first and second panels 34 and 36 are made from a woven fabric comprised of extended chain polyethylene fibers as described above, the results of the invention also can be achieved with other similar high strength ballistic-resistant polymeric fibers such as aramid fiber, which include fibers available under the designation KEVLAR; nylon fibers; polyolefin fibers such as polypropylene; and polyvinyl alcohol fibers such as those described in U.S. Pat. No. 4,681,792, incorporated herein by this reference.

The third flexible ballistic-resistant panel 38 preferably comprises a plurality of thin, flexible unidirectional fiber-reinforced plastic film sheets 38'. Each film sheet is reinforced with an array of ultra high molecular weight high tensile strength ballistic-resistant polymeric fibers embedded in a thermoplastic resinous matrix film. The preferred reinforcing fibers comprise a unidirectional (non-woven) extended chain ultra high molecular weight polyethylene ballistic fiber. The preferred fiber reinforced thermoplastic sheet is available under the designation SPECTRA FLEX manufactured by Allied Signal using a proprietary unidirectional fiber/resin process in which the fibers comprise the SPECTRA 1000 fibers. The fibers comprise 1300 denier fibers and 240 filaments, approximately 5.4 dewier per filament. Elongation at break is approximately 3.4%. The fiber tenacity is about 33 gm/denier and the tensile modulus is about 1500–1700 gm/denier. The preferred SPECTRA FLEX resinous matrix is made from a proprietary thermoplastic elastomer. The areal density of the material is about 4.5 oz/yd$^2$.

The fourth ballistic panel 40 is preferably made from a plurality of thin, flexible fiber-reinforced plastic film sheets 40' similar to the third ballistic panel. The film sheets of the fourth ballistic panel are preferably a unidirectional SPECTRA 1000 material similar to the SPECTRA FLEX material except that the individual plies 38' of the SPECTRA FLEX material are subjected to a crimping process which enhances their flexibility and the thickness of the individual layers, compared to the flatter non-crimped plies 40' of the fourth panel. The non-crimped unidirectional fiber-reinforced sheets 40' of the fourth panel are available from Allied Signal under the designation SPECTRA Shield. Otherwise the fiber materials and thermoplastic materials are similar to the SPECTRA FLEX material.

The individual fiber-reinforced plastic film sheets of the third and fourth panels are preferably secured together by bar stitching so as to hold the film sheets of each panel together as a unit while permitting inter-ply flexibility and mobility between the individual flexible fiber reinforced plastic sheets of each panel.

In one embodiment of the invention, the first panel section 34 consists of 28 plies of SPECTRA 180 woven fibers stitched together by one inch quilt stitching on a diamond pattern; the second ballistic panel comprises 15 plies of the SPECTRA 180 woven fabric material quilt stitched together on a box pattern; the third panel comprises 5 plies of the SPECTRA FLEX fiber-reinforced plastic film sheet layers bar tacked together as a unit; and the fourth panel comprises 5 plies of the SPECTRA Shield fiber-reinforced ballistic film sheet material secured together by bar tacking.

The areal weight of the complete package is less than about one pound per square foot. An objective in designing body armor for use by law enforcement officers is to equip the officer with body armor that will be work consistently day after day with a reasonably good comfort level produced by the light weight and flexibility of the composite vest material. There is a direct correlation between aerial weight (weight of a 12"×12" section of the ballistic package) of a vest and its comfort level. In the present invention one objective was to produce a ballistic sandwich having an areal weight of less than about 1.0 pound per square foot while achieving resistance to projectile penetration that meets NIJ Standard 0101.03 certification testing for Threat Level III-A for 0.44 Magnum 240 Grain SWC gas check and 9 mm 124 grain FMJ projectiles filed at a velocity of at least 1450 feet per second (fps) and while achieving backface deformation test standards under NIJ standard 0101.03 Level III-A having a maximum allowable bfs of 44 mm (0.44 Magnum and 9 mm rounds). In the presently preferred embodiment of the invention described previously, an areal weight of less than one pound per square foot has been achieved while meeting the Level III-A NIJ certification standards for resistance to projectile penetration and backface deformation.

The multi-component ballistic vest of this invention provides a unique combination of light weight, high flexibility, and ballistic resistance. In the described embodiment, splitting the plies of woven ballistic material into two groups provides improved performance. The first group of woven plies on the strike side of the vest overpowers the projectile and tends to flatten it, with the plies of the second woven layer being aligned better to also provide the function of flattening the projectile. The unidirectional fiber-reinforced sheets on the body side then stop penetration of the flattened projectile. The third panel contains the crimped SPECTRA FLEX sheets which when layered together provide a thicker sub-panel than the SPECTRA Shield material of the fourth panel. The crimping produces air spaces in the third panel which improves deflection of the projectile while the stiffer SPECTRA Shield layers on the body side provide a hard shield for the deflected round. The invention thus provides a good combination of deflection and energy absorption ability.

EXAMPLE

A ballistic vest was tested with 43 plies of woven SPECTRA 180 fabric layers quilt-stitched on one inch centers (strike side) and ten plies of SPECTRA FLEX unidirectional ballistic fiber-reinforced sheets (body side). It was observed that the more the ballistic structure was shot the better it performed, i.e., the more it was impacted the better it would deflect a test round. It was determined that a test should be conducted in which the woven SPECTRA 180 fabric layers would be split into two separate sub-panels. The front sub-panel contained 28 plies and the second sub-panel contained 15 plies of the woven SPECTRA 180 fabric. The reason was that in all testing at 1400 plus 50, none of the 0.44 Magnum impacts penetrated more than 28 plies. This would allow the additional 15 plies in the second sub-panel of fabric behind the 28 plies to maintain ballistic integrity by keeping the quilt stitch intact. It would also help the back-face performance and flexibility.

The test results shown below in Table I summarize a first test performed with the modified design in abbreviated NIJ test. The results were positive in that backface results with 0.44 Magnum rounds had slight improvement; there did not seem to be any improvement in the depth of penetration, but there was significant improvement in the V-50 test with the 0.44 Magnum rounds.

Table II shows regression curve data indicating even more significant improvement over the original design for both the 0.44 Magnum and the 9 mm test. The original design had a 12% penetration rate with the 0.44 Magnum rounds at 1450 plus 50 and the new design showed no penetration at this velocity range. The previous design showed a penetration rate of 18% with the 0.44 Magnum rounds at 1500 plus 50, and the new design had a 6% penetration rate. The previous design showed a 6% penetration rate at 1500 plus 50 with the 9 mm rounds and the new design had a zero rate.

Table III shows NIJ Level III-A certification tests which were passed by the new ballistic vest design. The back face depth of penetration and V-50 performance showed significant improvements and testing was passed with a ballistic package having an areal weight of 0.99 pound per square foot.

TABLE I

| TEST AND EVALUATION RESULTS | | | | | | | | | |
|---|---|---|---|---|---|---|---|---|---|
| | | VELOCITY | | DEFORMATION | | | PEN OF LAYERS | | |
| PANEL | PROJ. | MAX. | MIN. | MAX. | MIN. | AVG. | MAX. | MIN. | AVG. |
| Front (wet) | .44 Mag | 1463 | 1414 | 39 mm | | | 17 | 6 | 12 |
| Back (wet) | .44 Mag | 1442 | 1412 | | 36 mm | | 19 | 4 | 12 |
| Front (dry) | .44 Mag | 1451 | 1401 | 44 mm | | | 18 | 2 | 11 |
| Back (dry) | .44 Mag | 1442 | 1408 | | 37 mm | | 28 | 4 | 13 |
| Front (wet) | 9 mm | 1485 | 1405 | 90 mm | | | 22 | 10 | 14 |
| Back (wet) | 9 mm | 1452 | 1419 | | 90 mm | | 28 | 15 | 17 |
| Front (dry) | 9 mm | 1447 | 1415 | 30 mm | | | 28 | 15 | 17 |
| Back (dry) | 9 mm | 1448 | 1437 | | 90 mm | | 28 | 17 | 19 |

| V-50 RESULTS | | | | |
|---|---|---|---|---|
| PANEL | PROJ. | V-50 | H. PARTIAL | I. COMPLETE |
| Front | .44 Mag | 1616 | 1627 | 1596 |
| Front | 9 mm | 1828 | 1866 | 1814 |

TABLE II

| TEST AND EVALUATION RESULTS | | | | | | | | | |
|---|---|---|---|---|---|---|---|---|---|
| | | VELOCITY | | DEFORMATION | | | PEN OF LAYERS | | |
| PANEL | PROJ. | MAX. | MIN. | MAX. | MIN. | AVG. | MAX. | MIN. | AVG. |
| Front (wet) | .44 Mag | 1434 | 1410 | 41 mm | | | 28 | 9 | 16 |
| Back (wet) | | | | | | | | | |
| Front (dry) | | | | | | | | | |
| Back (dry) | .44 Mag | 1437 | 1416 | | 40 mm | | 25 | 8 | 14 |
| Front (wet) | 9 mm | 1472 | 1435 | 32 mm | | | 29 | 15 | 19 |
| Back (wet) | | | | | | | | | |
| Front (dry) | | | | | | | | | |
| Back (dry) | 9 mm | 1448 | 1437 | | 90 mm | | 29 | 14 | 19 |

| V-50 RESULTS | | | | |
|---|---|---|---|---|
| PANEL | PROJ. | V-50 | H. PARTIAL | I. COMPLETE |
| Front | .44 Mag | 1674 | 1688 | 1661 |
| Back | .44 Mag | 1656 | 1874 | 1638 |
| Front | 9 mm | 1672 | 1690 | 1636 |
| Back | 9 mm | 1651 | 1699 | 1630 |

TABLE III

| | | TEST AND EVALUATION RESULTS | | | | | | | |
|---|---|---|---|---|---|---|---|---|---|
| | VELOCITY | VELOCITY | | DEFORMATION | | | PEN OF LAYERS | | |
| PROJ. | RANGE | MAX. | MIN. | MAX. | MIN. | AVG. | MAX. | MIN. | AVG. |
| .44 Mag | 1400 + 50 | 1454 | 1401 | 47 mm | 37 mm | 39 mm | 19 | 4 | 12 |
| .44 Mag | 1450 + 50 | 1488 | 1434 | 53 mm | 36 mm | 41 mm | 28 | 6 | 18 |
| .44 Mag | 1500 + 50 | 1550 | 1498 | 50 mm | 35 mm | 44 mm | 1P | 16 | 27 |
| 9 mm | 1400 + 50 | 1462 | 1452 | 30 mm | 29 mm | 27 mm | 28 | 15 | 19 |
| 9 mm | 1450 + 50 | 1524 | 1428 | 32 mm | 23 mm | 27 mm | 28 | 15 | 19 |
| 9 mm | 1500 + 50 | 1558 | 1508 | 34 mm | 20 mm | 27 mm | 29 | 16 | 22 |

| | | V-50 RESULTS | | |
|---|---|---|---|---|
| PANEL | PROJ. | V-50 | H. PARTIAL | I. COMPLETE |
| 16" × 16" | 9 mm | 1645 | 1658 | 1622 |
| 16" × 16" | .44 Mag | 1622 | 1653 | 1585 |

What is claimed is:

1. A multi-component ballistic vest of a soft body armor type comprising:

a composite protective panel having ballistic resistance comprising a first flexible sub-panel on a strike side of the vest, a second flexible sub-panel positioned adjacent the first sub-panel, a third flexible sub-panel positioned adjacent to the second sub-panel, and a fourth flexible sub-panel on a body side of the vest, the first flexible sub-panel comprising a first group of flexible woven fabric layers arranged in a stack in face-to-face surface contact, each first woven fabric layer comprising an array of woven high molecular weight high tensile strength ballistic-resistant polymeric fibers, the individual first woven fabric layers being secured to each other to form a flexible unitary first sub-panel, the second flexible sub-panel comprising a second group of flexible woven fabric layers arranged in a stack in face-to-face surface contact, each second woven fabric layer comprising an array of woven ultra high molecular weight high tensile strength ballistic-resistant polymeric fibers, the individual second woven fabric layers being secured to each other to form a flexible unitary second sub-panel, the third flexible sub-panel comprising a group of flexible imperforate ballistic fiber-reenforced plastic sheets arranged in a stack in face-to-face surface contact, each fiber-reinforced sheet of the third sub-panel comprising an array of non-woven ballistic-resistant plastic fibers embedded in a resinous matrix type film, the individual ballistic fiber-reinforced plastic sheets of the third sub-panel being secured to each other to form a flexible unitary third sub-panel;

the fourth flexible sub-panel comprising a group of flexible imperforate ballistic fiber-reinforced plastic sheets arranged in a stack in face-to-face surface contact, each imperforate plastic sheet of the fourth sub-panel comprising an array of non-woven plastic fibers embedded in a resinous matrix type film, the individual fiber-reinforced sheets of the fourth sub-panel being secured to each other to form a flexible unitary fourth sub-panel, the ballistic resistance of the composite ballistic package being provided essentially in its entirety from the strike side of the composite panel through the first, second, third and fourth sub-panels to the body side of the ballistic package; the first, second, third and fourth flexible sub-panels having a combined areal weight not greater than about 1.0 pound per square foot and having an NIJ standard maximum backface of about 44 mm with a ballistic resistance that prevents projectile penetration of the combined first, second, third and fourth flexible sub-panels according to NIJ Standard 0101.03 for Threat Level III-A.

2. The ballistic vest according to claim 1 in which the ballistic fibers contained in the first, second, third and fourth sub-panels comprise extended chain high molecular weight polyethylene fibers.

3. The ballistic vest according to claim 1 in which the woven fabric plies of the first sub-panel are greater in number than the woven fabric plies of the second sub-panel.

4. The ballistic vest according to claim 3 in which the individual ballistic fiber-reinforced sheets of the third and fourth sub-panels comprise similar ballistic fiber materials.

5. The ballistic vest according to claim 4 in which the ballistic fiber-reinforced sheets of the third sub-panel have enhanced flexibility and thickness when compared with the ballistic fiber- reinforced plastic sheets of the fourth sub-panel.

6. The ballistic vest according to claim 1 in which the first and second sub-panels have their individual woven fabric plies secured together by quilt stitching, and in which the quilt stitching pattern of the first sub-panel is different from the quilt stitching pattern of the second sub-panel.

7. The ballistic vest according to claim 6 in which the ballistic package comprises about 28 plies of the first woven fabric, about 15 plies of the second woven fabric, about 5 plies of the third sheet material and about 5 plies of the fourth sheet material.

8. A ballistic vest of a soft body armor type comprising a multi-component ballistic package having a first sub-panel comprising a plurality of woven ballistic fabric sheets comprising ultra high molecular weight ballistic fibers in which the individual woven fabric sheets in the first sub-panel are secured together as a unit and positioned on the strike side of the vest; a second sub-panel comprising a plurality of woven ballistic fabric sheets comprising ultra high molecular weight ballistic fibers in which the individual woven fabric sheets in the second sub-panel are secured together as a unit and positioned adjacent to and behind the first sub-panel; the number of ballistic fabric layers in the first sub-panel exceeding the number of layers of ballistic fabric sheets in the second sub-panel; and at least one third sub-panel comprising a plurality of unidirectional ballistic fiber-reinforced plastic sheets secured together and positioned behind the second panel on the body side of the vest to provide energy absorption for a projectile flattened by penetrating contact with the first and second sub-panels.

9. The ballistic vest according to claim 8 in which the ballistic fibers of the first and second sub-panels comprise ultra high molecular weight extended chain polyethylene fibers.

10. The ballistic vest according to claim 9 in which the unidirectional fibers of the third sub-panel comprise ultra high molecular weight extended chain polyethylene fibers.

11. The ballistic vest according to claim 9 in which the ballistic package has an areal weight of less than one pound per square foot and meets Threat Level III-A NIJ certification standards.

12. The ballistic vest according to claim 8 in which the woven fabric layers comprise ballistic-resistant fibers selected from the group consisting of nylon, aramid, polyethylene, polypropylene and polyvinyl alcohol fibers.

13. The ballistic vest according to claim 8 in which the unidirectional fibers contained in the third sub-panel are selected from the group consisting of nylon, aramid, polyethylene, polypropylene and polyvinyl alcohol fibers.

14. The ballistic vest according to claim 8 in which the first and second sub-panels are each quilt-stitched.

15. The ballistic vest according to claim 14 in which the quilt stitch pattern of the first sub-panel is different from the quilt stitch patter of the second sub-panel.

* * * * *

UNITED STATES PATENT AND TRADEMARK OFFICE

CERTIFICATE OF CORRECTION

PATENT NO. : 5,724,670
DATED : March 10, 1998
INVENTOR(S) : Allen L. Price

It is certified that error appears in the above-indentified patent and that said Letters Patent is hereby corrected as shown below:

Column 2, line 19, change "fiber-reenforced" to -- fiber-reinforced --.
Column 5, line 50, change "dewier" to -- denier --.
Column 6, line 23, replace "that will be work" with -- that will work --.
Column 6, line 26, change "aerial" to -- areal --.
Column 9, line 7, Table III, under "MAX," change "1P" to -- 38 --.
Column 9, line 48, change "fiber-reenforced" to -- fiber-reinforced --.
Column 10, line 43, change -- fiber- reinforced -- to -- fiber-reinforced --.
Column 12, line 15, change "patter" to -- pattern --.

Signed and Sealed this

Eighteenth Day of April, 2000

*Attest:*

Q. TODD DICKINSON

*Attesting Officer*

*Director of Patents and Trademarks*